United States Patent [19]

Mullner

[11] 4,058,924

[45] Nov. 22, 1977

[54] PRETRIGGERABLE TRIGGER MECHANISM FOR SPORTING RIFLES

[75] Inventor: Franz Mullner, Steyr, Austria

[73] Assignee: Steyr-Daimler-Puch Aktiengesellschaft, Vienna, Austria

[21] Appl. No.: 727,139

[22] Filed: Sept. 27, 1976

[30] Foreign Application Priority Data

Oct. 6, 1975 Austria .....7640/75

[51] Int. Cl.[2] ..... F41C 19/02

[52] U.S. Cl. ..... 42/69 R

[58] Field of Search ..... 42/69 R, 69 A, 69 B

[56] References Cited

U.S. PATENT DOCUMENTS

| | | | |
|---|---|---|---|
| 698,440 | 4/1902 | Brown | 42/69 R |
| 771,806 | 10/1904 | Brown | 42/69 A |
| 852,942 | 5/1907 | Fisher | 42/69 R |
| 1,625,768 | 4/1927 | Barnes | 42/69 A |
| 2,556,025 | 6/1951 | Canjar | 42/69 A |
| 2,558,872 | 7/1951 | Miller | 42/69 A |

*Primary Examiner*—Charles T. Jordan
*Attorney, Agent, or Firm*—Kurt Kelman

[57] ABSTRACT

A rifle trigger mechanism comprises a sear spring-urged into an intercepting position and pivotal into a non-intercepting position. An intermediate lever is pivotal into a locking position in which it backs the sear in the intercepting position. A trigger is pivotal from an intermediate position forwardly to a preset position and rearwardly to a triggered position. The trigger has an extension for direct engagement with the lever in the locking position when in the intermediate position, to be clear thereof when in the preset position, and to cause the lever to move out of the locking position to release the sear for a movement out of the intercepting position in response to a movement of the trigger from the intermediate to the triggered position. A compression spring opposes a trigger movement to the preset position and is arranged to cause the trigger to move beyond the intermediate position to the triggered position when the trigger has been slightly moved from the preset toward the intermediate position.

3 Claims, 2 Drawing Figures

PRETRIGGERABLE TRIGGER MECHANISM FOR SPORTING RIFLES

Figure 1:
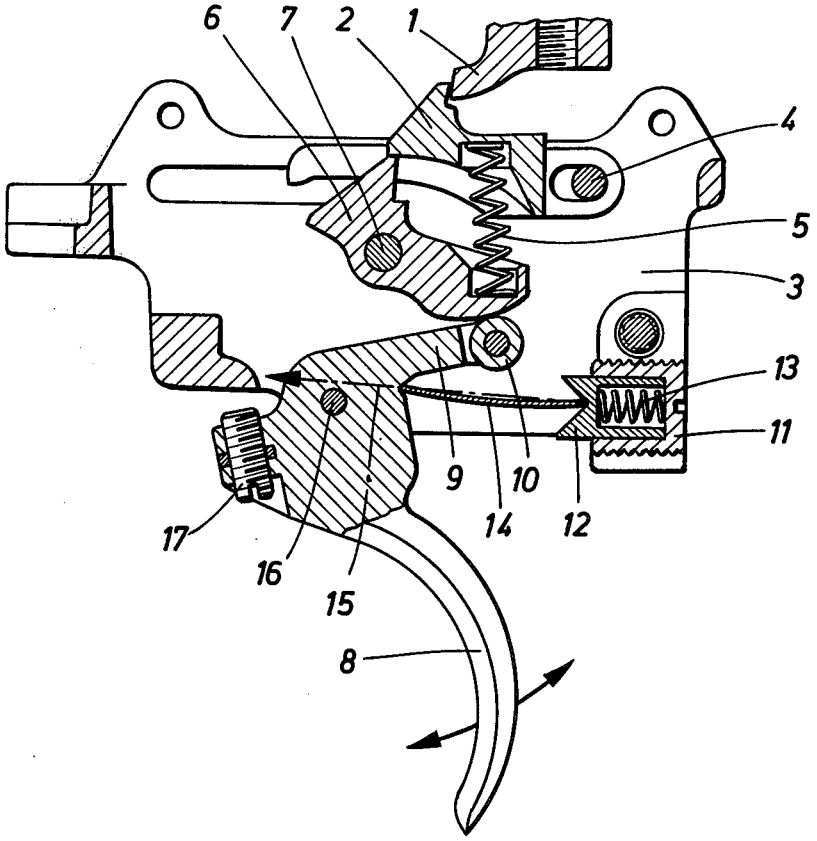

This invention relates to a presettable trigger mechanism for sporting rifles, comprising a sear, which is adapted to be pivotally movable downwardly against a spring bias and in an intercepting position engages a firing pin cam and is backed by an intermediate lever, which is pivoted on a fixed axis, and a trigger which actuates the intermediate lever.

When the trigger of a conventional trigger mechanism which is not presettable, is pivotally moved toward the butt and a certain adjustable lost motion has been performed, the intermediate lever is pivotally moved so that the sear is no longer backed, the cam of the firing pin is released and the firing pin can spring forwardly under the action of the firing pin spring. A presettable trigger mechanism can be moved to a position in which a very slight movement of the trigger or the action of a very slight force on the tongue is sufficient to discharge the shot. To preset the trigger mechanism, the trigger is pivotally moved in a sense which opposes the sense of the usual pivotal movement performed by the trigger as it is pulled.

In a known presettable trigger mechanism, the trigger does not act directly on the intermediate lever but a rocker mounted on the axis of the trigger is provided between the trigger and the intermediate lever and serves to actuate the intermediate lever. An intercepting pawl biased by a tension spring is required for that rocker. When a forward pivotal movement is imparted to the trigger to preset the mechanism, when the intercepting pawl is released and the rocker is moved until it engages the intercepting pawl. A very slight movement of the trigger will then be sufficient to disengage the rocker and intercepting pawl so that the rocker under a corresponding spring action can actuate the intermediate lever so that it no longer backs the sear and the stop of the firing pin is released. That arrangement has the disadvantage that the mechanism is rather complicated and consists of numerous parts because two parts, namely, the rocker and the intercepting pawl, are provided between the trigger and the intermediate lever. Besides, that portion of the rocker which contacts the intercepting pawl, as well as the pawl itself, are subjected to heavy wear so that a readjustment is frequently required.

In another presettable trigger mechanism, the trigger has an extension which acts directly on the intermediate lever, and a compression spring is retained between the tongue and the intermediate lever and is stressed by a forward pivotal movement of the trigger as the mechanism is preset (Opened German Specification No. 2,214,916). In that known mechanism, there is no sear which is backed by the intermediate lever but the extension of the trigger acts on a trigger rod, which releases a cocked striker. This mechanism is also complicated and for this reason is liable to be deranged and can be adjusted only with difficulty because the compression spring which is stressed as the mechanism is preset acts on a separate, presettable striker, which is mounted in a groove of the trigger extension for a pivotal lost motion about the axis of the trigger. This presettable striker is held in its cocked position by a separate pawllike presettable catch, which is biased at one end by an additional leaf spring and bears at its other end on an adjusting screw. That mechanism consists not only of numerous parts but has the further disadvantage that the end of the presettable striker snaps with an audible click under the nose of the presettable catch as the mechanism is preset. Such audible click is not desirable for a sporting rifle. Finally, the interengaging portions are subjected to wear so that there is a risk that the preset position is no longer reliably assumed when the rifle has been used for a fairly long time.

It is an object of the invention to eliminate these disadvantages and to provide a trigger mechanism which is of the kind described first hereinbefore and which is structurally simple and reliable in use, can be preset without noise, and is subject only to a small wear.

This object is accomplished according to the invention in that the trigger has an extension which acts directly on the intermediate lever, a compression spring is retained between the trigger and an abutment and is adapted to be stressed by the trigger during its forward pivotal movement as the mechanism is preset, and the line of action of the compression spring extends forwardly through the pivotal axis of the trigger when the same is in its preset position, in which the extension of the trigger is clear of the intermediate lever.

Because the extension of the trigger acts directly on the intermediate lever, the rifle can be triggered in the usual manner, i.e., when the lock has been cocked a simple rearward pivotal movement of the trigger will actuate the intermediate lever so that the sear is no longer backed and the cam of the firing pin is released. On the other hand, when the trigger is pivotally moved forwardly to preset the mechanism, the extension of the trigger clears the intermediate lever and the compression spring retained between the trigger and the abutment is stressed at the same time. When the trigger has reached the preset position, the line of action of the compression spring extends through the pivotal axis of the trigger so that no torque is exerted on the trigger and the entire mechanism is virtually in a state of unstable equlibrium and is held therein only by the inevitable friction. For this reason a slight movement of the trigger or the action of even a slight force on the trigger is sufficient to move the line of action of the compression spring away from the pivotal axis of the trigger. As soon as this has been accomplished, the trigger is subjected to an increasing torque so that the compression spring causes the extension of the trigger to act on the intermediate lever with a corresponding momentum. It is apparent that the mechanism is simple because it is sufficient to add the spring and the abutment. The presettable trigger mechanism does not require parts that are subjected to heavy wear.

According to a preferred feature of the invention the abutment for the compression spring is supported in the trigger housing by resilient cushioning means acting approximately in the direction of action of the compression spring. These resilient cushioning means ensure that the compression spring will be retained during movements of the trigger and ensure that the engagement of the extension of the trigger with the intermediate lever will be maintained before the mechanism is preset even though the compression spring may not be prestressed. To enable a corresponding fine adjustment, it is a preferred feature of the invention that a bearing bushing, which is adjustable approximately in the line of action of the compression spring, is provided for the spring which cushions the abutment.

According to a further preferred feature of the invention the compression spring consists of a slightly prebent leaf spring. The use of such spring will further simplify the mechanism because the spring can easily be mounted in angle-shaped recesses so that an exact line of action is defined. The prebent configuration of the spring inherently defines the direction in which the spring is subsequently deflected as it is stressed.

Figure 2:
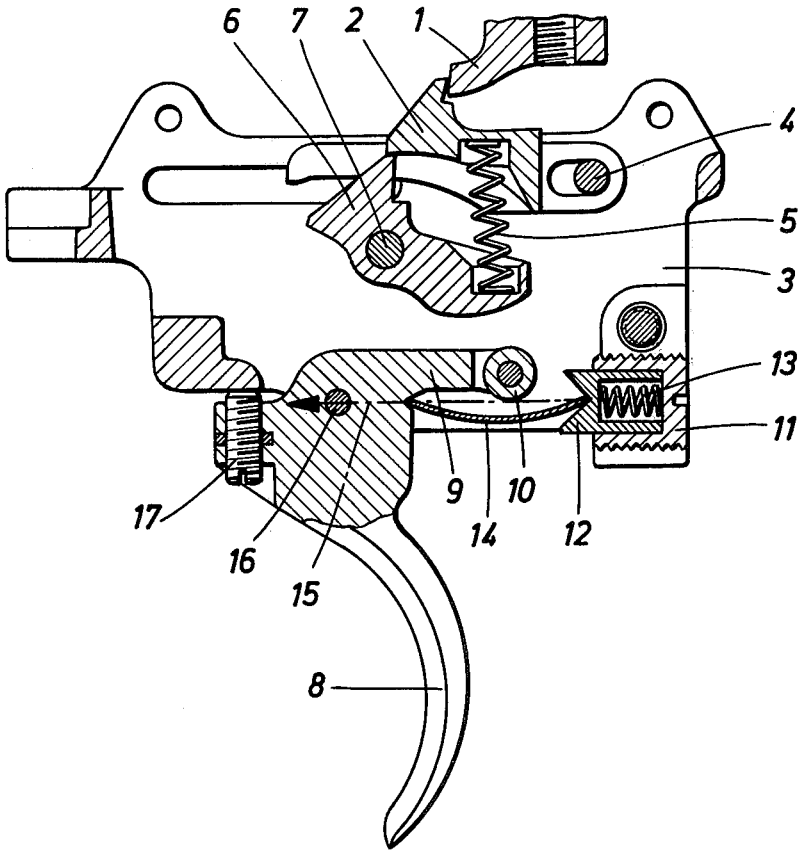

An embodiment of the invention is shown by way of example on the drawing, in which FIGS. 1 and 2 are vertical central sectional views showing a trigger mechanism of a sporting rifle when the lock is cocked, i.e., the sear has intercepted the stop of the firing pin, in the normal position for triggering and in the present position.

The firing pin is represented here only by its cam 1, which is engaged by the sear 2 when the lock is cocked. The sear 2 is pivoted in the trigger mechanism housing 3 on the pin 4 and is pivotally movable downwardly against the force of a compression spring 5. In the intercepting position shown on the drawing, the sear is backed by an intermediate lever 6, which is pivoted on a fixed pivot 7. The trigger 8 has an extension 9, which is provided with a roller 10, which acts on the intermediate lever 6. A bearing bushing 11 is mounted in the trigger mechanism housing 3 by means of screw threads which permit of an adjustment. The bearing bushing 11 provides a guide for an abutment 12, which is acted upon by a coil spring 13. A compression spring 14 consisting of a slightly prebent leaf spring is inserted between the abutment 12 and the trigger 8.

The rifle can be normally triggered when the various parts of the trigger mechanism are in the position shown in FIG. 1. Under the action of the spring 13, the roller 10 carried by the extension 9 is held in engagement with the intermediate lever 6 whereas the leaf spring 14 is relaxed. When the trigger is now pivotally moved in the normal, counterclockwise sense, the intermediate lever 6 will perform a pivotal movement so that the sear 2 is deprived of its backing and is forced downwardly under the action of the firing pin spring against the force of the spring 5. The firing pin cam 1 is now released so that the firing pin can spring forwardly.

When the trigger 8 is moved from the position shown in FIG. 1 in the clockwise sense to the position shown in FIG. 2 to preset the mechanism, the extension 9 will clear the intermediate lever 6 and the spring 14 will be stressed and deflected. The arrangement is such that when the trigger 8 is in its preset position, the line of action 15 of the spring 14 extends through the pivotal axis of the trigger 8, i.e., through the axis of the pin 16, so that the spring 14 does not exert a torque on the trigger. The slightest movement of the trigger 8 will not cause the line of action 15 to move away from the axis of the pin 16 so that the spring 14 can relax and exert a torque which causes the roller 10 carried by the extension 9 to strike against the intermediate lever 6 and initiate the above-described sequence of operations to discharge a shot.

The position of the line of action 15 of the spring 14 in the preset position of the mechanism can be adjusted by the screw 17. The bearing bushing 11 can be adjusted to ensure that the compression spring 14 will not be prestressed when the roller 10 engages the intermediate lever 6 in the position shown in FIG. 1.

What is claimed is:

1. A pretriggerable trigger mechanism for sporting rifles, which comprises a sear, which is pivotally movable between an intercepting position and a non-intercepting position, a sear spring urging said sear toward said intercepting position, an intermediate lever pivoted on a stationary axis and adapted to assume a locking position, in which said intermediate lever backs said sear in said intercepting position, a trigger, which is adapted to assume an intermediate position and pivotally movable on a pivotal axis from said intermediate position forwardly to a defined set position and rearwardly to a triggered position, said trigger having an extension, which is arranged directly to engage said intermediate lever in said locking position when said trigger is in said intermediate position, to be clear of said intermediate lever when said trigger is in said preset position, and to cause said intermediate lever to move out of said locking position to release said sear for a movement out of said intercepting position toward said non-intercepting position against the action of said sear spring in response to a movement of said trigger from said intermediate position to said triggered position an abutment, and a compression spring retained between said abutment and said trigger and opposing a movement of said trigger to said preset position, said spring being arranged to have a line of action extending through said pivotal axis when, and only when, said trigger is in said preset position, said compression spring being arranged to cause said trigger to move beyond said intermediate position to said triggered position when said trigger has been slightly moved from said preset position toward said intermediate position.

2. A trigger mechanism as set forth in claim 1, which comprises a trigger mechanism housing, in which said sear, sear spring, intermediate lever, trigger, compression spring, and abutment are mounted and resilient cushioning means interposed between said abutment and said housing.

3. A trigger mechanism as set forth in claim 2, in which said resilient cushioning means comprise a bearing bushing, in which said abutment is slidably mounted and which is connected to said housing by screw threads permitting of an adjustment of said bearing bushing generally along the line of action of said compression spring, and a cushioning spring retained in said bearing bushing and bearing on said abutment.

* * * * *